US005201008A

United States Patent [19]

Arndt et al.

[11] Patent Number: 5,201,008

[45] Date of Patent: Apr. 6, 1993

[54] MODULAR HEARING AID WITH LID HINGED TO FACEPLATE

[75] Inventors: Horst Arndt; Edward S. Kroetsch, both of Kitchener, Canada

[73] Assignee: Unitron Industries Ltd., Kitchener, Canada

[21] Appl. No.: 707,295

[22] Filed: Nov. 28, 1989

Related U.S. Application Data

[63] Continuation of Ser. No. 7,032, Jan. 27, 1987, abandoned.

[51] Int. Cl.[5] ..... H04R 25/00

[52] U.S. Cl. ..... 381/68.6; 381/68; 381/69; 381/69.2

[58] Field of Search ..... 381/68, 68.6, 69, 69.2

[56] References Cited

U.S. PATENT DOCUMENTS

| | | | |
|---|---|---|---|
| 3,345,737 | 10/1967 | Gordon | 264/222 |
| 3,496,306 | 2/1970 | Pollack | 381/68.6 |
| 3,598,928 | 8/1971 | Hickox | 381/68.6 |
| 4,069,400 | 1/1978 | Johanson et al. | 381/68.6 |
| 4,471,490 | 9/1984 | Bellafiore | 381/68.6 |
| 4,584,437 | 4/1986 | Giannetti | 381/68.6 |
| 4,634,815 | 1/1987 | Marquis | 381/68.6 |
| 4,870,688 | 9/1989 | Voroba et al. | 381/69 |

FOREIGN PATENT DOCUMENTS 0085032 8/1983 European Pat. Off. .

OTHER PUBLICATIONS

WO-8606919, "Improvement in the Faceplates of Intracanal Hearing Aids", Gianetti, Vittorio, Nov. 1986.

*Primary Examiner*—Jin F. Ng
*Assistant Examiner*—Huyen D. Le
*Attorney, Agent, or Firm*—Bereskin & Parr

[57] ABSTRACT

A modular hearing aid to fit in the user's ear, having a shell, a faceplate fixed to the shell, and an electronic module removably snapped into the faceplate. The module includes an open-topped battery compartment which is closed by a lid hinged to the faceplate rather than to the module. This eliminates a bulky hinge on the module and allows a smaller snap fastener between the module and faceplate. The volume control on the module projects through an opening in the closed lid.

14 Claims, 6 Drawing Sheets

MODULAR HEARING AID WITH LID HINGED TO FACEPLATE

This is a continuation of application Ser. No. 07/007,032 filed Jan. 27, 1987 now abandoned.

FIELD OF THE INVENTION

This invention relates to a compact hearing aid of the kind generally referred to as an in-the-ear (or ITE) hearing aid.

BACKGROUND OF THE INVENTION

In-the-ear or ITE hearing aids have been manufactured for some time. Such aids include full concha aids, low profile full concha aids, half concha aids, canal aids, and semi-canal aids. In all cases there exists a need to build smaller hearing aids which will fit more ears. There is also a need to build such hearing aids with better performance and more features.

Traditional custom ITE hearing aids have been constructed by creating a shell which anatomically duplicates the relevant parts of the user's ear canal and concha. A receiver is placed in this shell, and then the open end of the shell is closed with a faceplate subassembly. The faceplate subassembly consists of an arrangement of individual components, typically an amplifier, microphone, volume control, battery compartment and potentiometers for adjusting the hearing aid performance to the user's individual needs. Adjustment or repair of the internal parts requires the faceplate to be cut away from the shell. This is an awkward procedure, and after repair or adjustment, subsequent buffing or polishing is needed to restore the hearing aid to an acceptable cosmetic appearance.

These difficulties have motivated the construction of modular hearing aids in which an electroacoustic module (consisting of a receiver, which is simply a miniature loudspeaker, a microphone, an amplifier, a battery compartment, a volume control and other optional controls) is mated into a faceplate with a matching opening. The module can be inserted into and removed from a faceplate-shell subassembly to make the building and repair of the hearing aid more efficient. However a detrimental consequence of modularity has been an increase in the size of finished hearing aid.

In all existing modular ITE hearing aids, the module contains a battery compartment with a battery compartment lid attached to the module. The size of the lid is determined by the dimensions of the battery and the space required to provide a hinge to fasten the battery lid to the modular insert. The hinged lid is opened frequently to exchange batteries, thus exerting wear and tear on the module. In current modular hearing aids, the module must fit snugly into the faceplate and must be securely attached to the faceplate by a suitable snap or fastening detail. Usually latches or the like are used to provide a secure fastening. Both the hinge and the fastening detail add considerably to the size of the module and thus to the size of the finished aid. As a result, modular ITE hearing aids which are presently available are not suitable for more than 40 to 50 percent of all ears which could be candidates for such hearing aids.

BRIEF SUMMARY OF THE INVENTION

The present invention provides a modular ITE hearing aid in which the battery compartment lid and hinge are removed from the module itself and are placed instead on the faceplate which is attached to a custom or stock shell. The stresses which arise from opening and closing the battery compartment lid are now exerted on the faceplate ring rather than on the modular insert. Consequently the module is not required to be as securely fastened in the faceplate. The space which is saved by not having to provide a hinge on the module, and by not having to provide as strong a fastening in the faceplate for the module, can therefore be used to provide features such as controls while still retaining a very small overall size for the finished aid. Tests have shown that a large percentage of adult ears in North America can be fitted with the modular hearing aid of this invention.

In one of its aspects the present invention provides a hearing aid comprising:

(a) a shell adapted to fit within a user's ear and having an outer rim, (b) a faceplate fixed to said outer rim and having an opening therein, (c) an electronic module comprising a microphone, an amplifier connected to said microphone to amplify sound therefrom, a receiver connected to said amplifier to produce sound for said user, and a battery compartment to house a battery for said amplifier, said module being removably fitted within said opening of said faceplate, (d) said battery compartment being open at its outer end, (e) a lid for said faceplate and having an inside surface, said inside surface defining a closure for said battery compartment, (f) and hinge means connected between said lid and said faceplate for said lid to be opened and closed, said lid being aligned for said closure for said battery compartment to close said battery compartment when said lid is closed, (g) and detent means for retaining said lid in a closed position.

In another aspect the invention provides for a hearing aid comprising a shell adapted to be fitted within a user's ear, and an electronic module containing electronic components and a battery compartment and adapted to be fitted to said shell, the improvement comprising a faceplate adapted to be connected to said shell and to house said module, said faceplate comprising an enlarged plastic plate, an opening in said plate adapted to receive said module, said plate having an upper surface, an annular rim encircling said opening and extending upwardly from said upper surface, and a hinge portion located on the upper edge of said rim, whereby material can be removed from said faceplate without damaging said hinge portion.

Further objects and advantages of the invention will appear from the following description, taken together with the accompanying drawings.

DESCRIPTION OF PREFERRED EMBODIMENT

Figure 1:
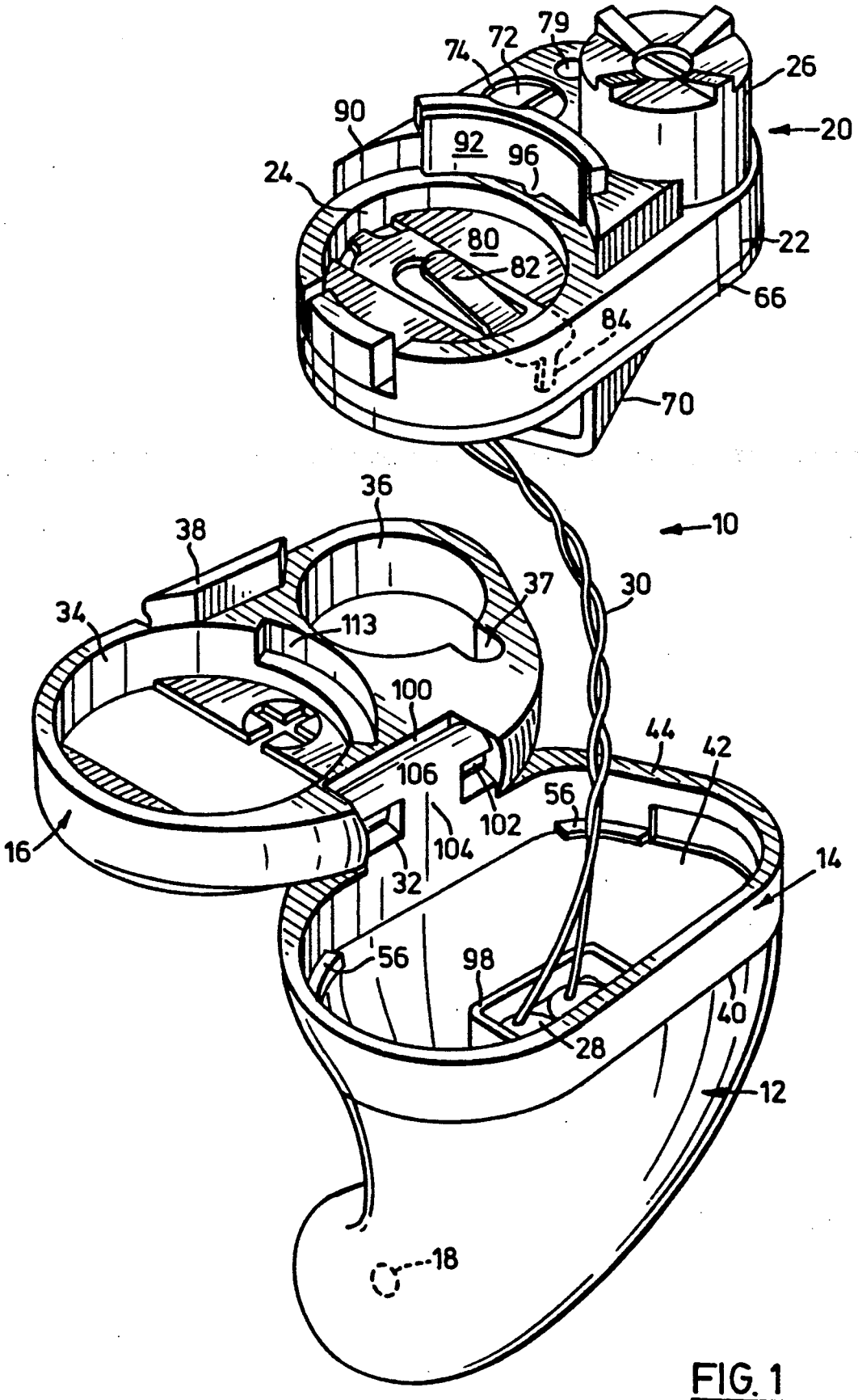
FIG. 1 is an exploded perspective view of a hearing aid according to the present invention with the electronic module removed from the aid and with the lid in open position.
Figure 2:
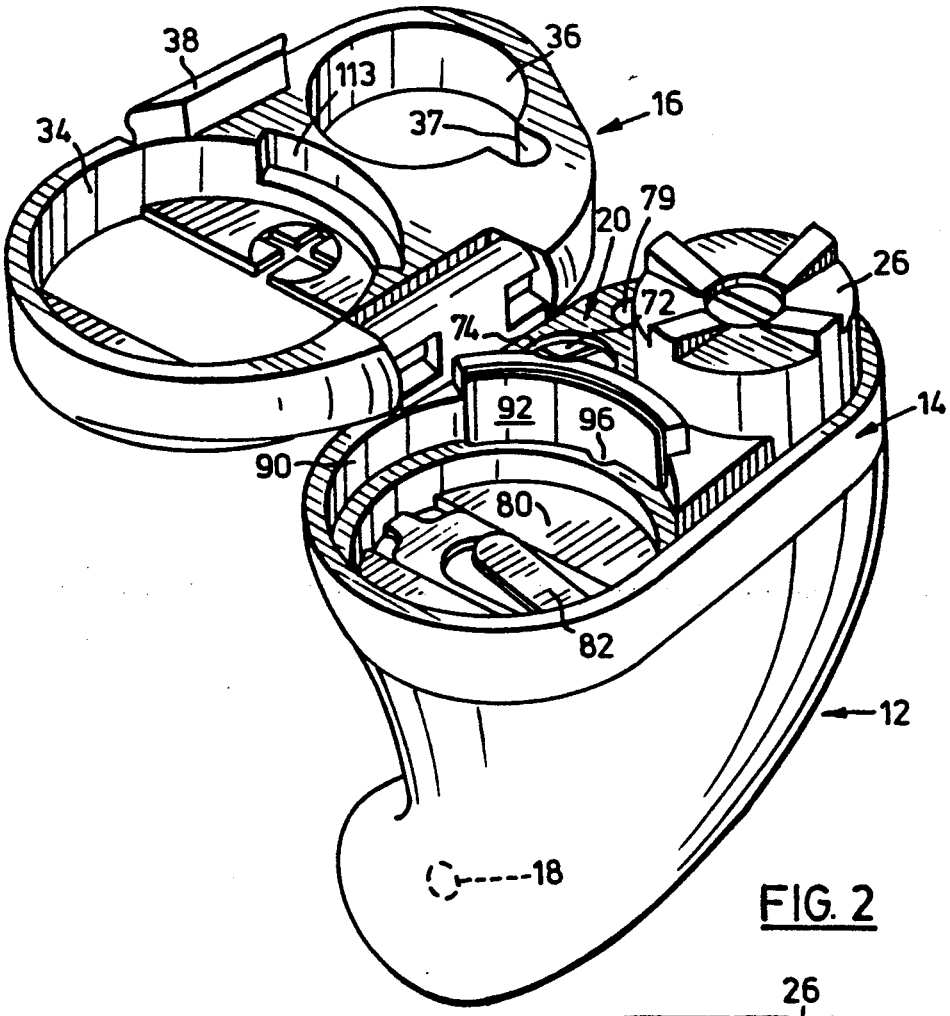
FIG. 2 is a perspective view similar to FIG. 1 but with the electronic module installed in the hearing aid.
Figure 3:
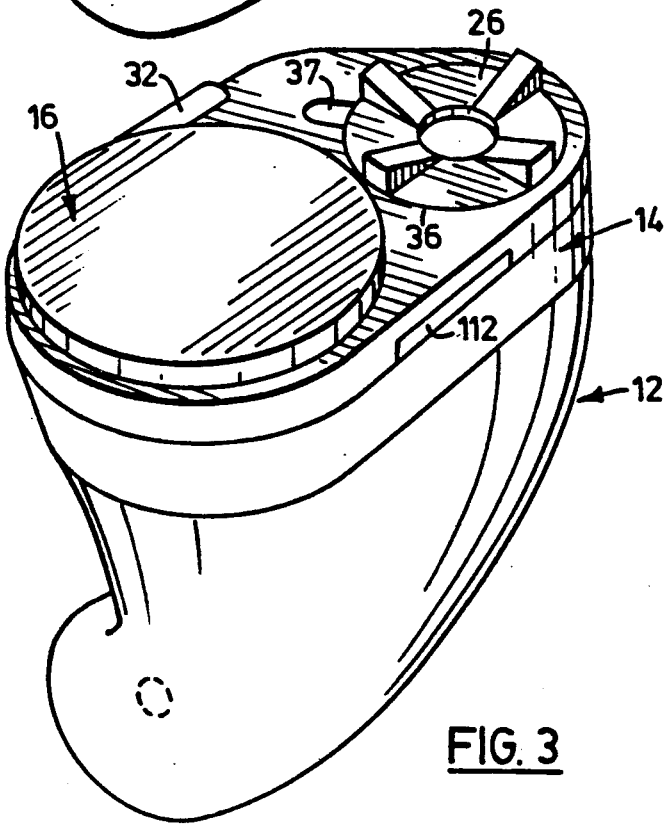
FIG. 3 is a perspective view similar to FIG. 2 but with the lid closed.

Reference is first made to FIGS. 1 to 3, which show a hearing aid 10 comprising a shell 12, a faceplate 14 and a lid 16. The shell 12 can be a stock (i.e. standard) shell or it can be custom molded to fit the customer's ear. The shell 12 includes an aperture 18 in its lower surface for sound from the hearing aid transducer (to be described) to enter the user's ear canal.

The particular hearing aid shown and described is a canal hearing aid for the right ear. An aid for the left ear would be the mirror image of that shown.

Figure 4:
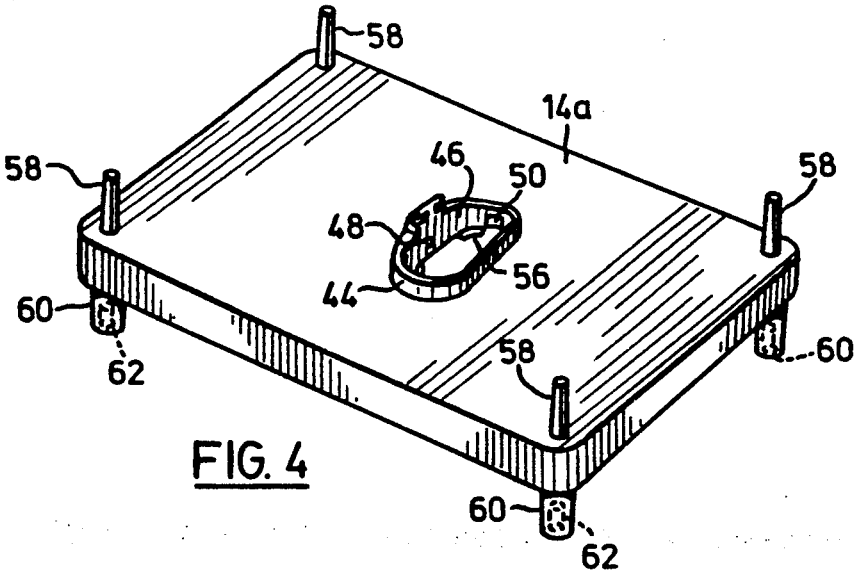
FIG. 4 is a perspective view of a faceplate used to form the faceplate ring of the invention, before material has been removed therefrom.

The faceplate 14 begins life as a rectangular plate 14*a* as shown in FIG. 4. As will be described, the plate 14*a* is glued to the shell 12, and the excess material is then removed leaving the faceplate 14 as shown in FIGS. 1 to 3.

Housed within the faceplate 14 and shell 12 is an electronic module 20. The module 20 comprises a plastic housing 22 which defines a battery compartment 24. The plastic housing 22 also supports a volume control 26 and various electronic components to be described. These components include a receiver 28 which is suspended from the module 20 by a pair of wires 30 and which produces the sound which is transmitted into the user's ear canal.

The lid 16 is connected by a hinge 32 to the faceplate 14 (as will be described in more detail) and includes in its lower surface a circular compartment 34 which forms a closure for the battery compartment 24. The lid 16 further includes an opening 36 through which the volume control 26 may project, and a small opening 37 to allow sound to reach the microphone (to be described) in the module 20. A plastic latch 38 on the lid 16 serves to latch the lid closed (as will be described).

The construction of the hearing aid 10 will now be described in more detail. Firstly, the shell 12 is conventionally molded of a suitable plastic, either in a standard (stock) shape or by using a casting of the user's ear canal. The resultant shell 12 has an upper edge 40 and an interior opening 42.

Figure 6:
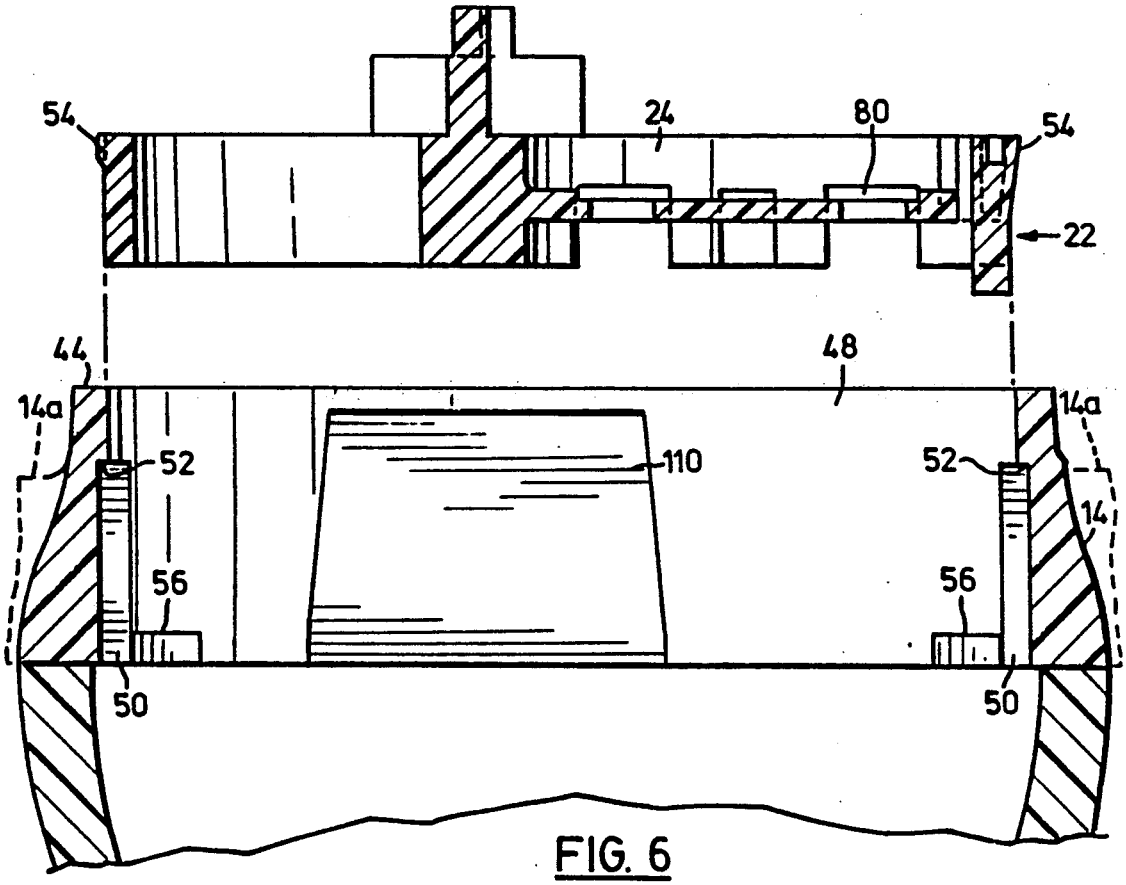
FIG. 6 is an exploded sectional view showing a faceplate, shell, and the plastic housing of the electronic module.
Figure 7:
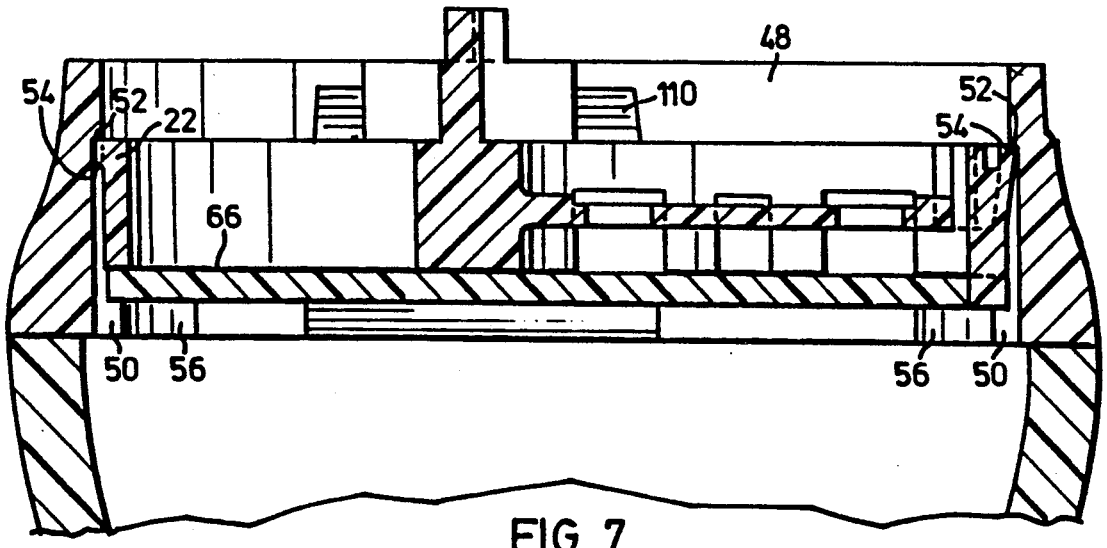
FIG. 7 is a sectional view similar to that of FIG. 6 but showing the module housing inserted in the faceplate.

The faceplate 14 is molded with an integral central annular rim 44 (FIG. 4) which extends upwardly from one surface of the faceplate and encircles an opening 46 in the faceplate. The opening 46 is the same in all faceplates and is designed to receive the module housing 22 with a snap fit. For this purpose the interior wall 48 of the opening 46 includes two shallow recesses 50 therein, one in each end thereof (see FIGS. 1, 4, 6 and 7). The recesses 50 terminate below the upper edge of rim 44, forming upper lateral surfaces or ledges 52 which retain the plastic housing 22. As shown in FIGS. 6 and 7, the plastic housing 22 has outwardly projecting tapered ends 54 which can be forced into the opening 46 and snap into the recesses 50.

Figure 5:
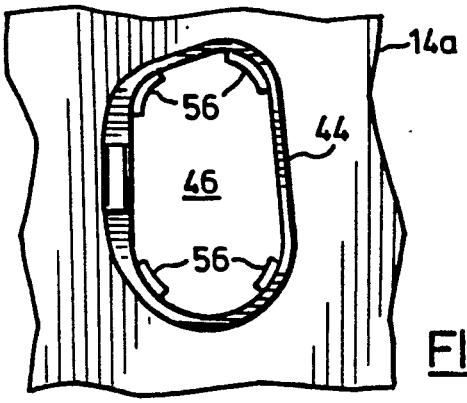
FIG. 5 is a top view of a portion of the faceplate of FIG. 4.

The faceplate 14 also includes four sector-shaped lower stops 56 (FIG. 5) which project laterally inwardly from its interior wall 48, adjacent the bottom of the faceplate. The stops 56 limit movement of the module housing 22 into the faceplate opening.

The faceplate 14 also includes four upper posts 58 and four lower posts 60, one at each corner thereof. The posts are used for stacking and handling. For this purpose the upper posts 58 are narrowed and their tips fit into corresponding openings 62 in the lower posts 60.

After the shell 12 has been formed, it is glued or ultrasonically welded to the faceplate 14 as shown in FIG. 6. While different shells may differ in contour, there is only one standardized faceplate 14 which is used for all shells. After the shell and faceplate are secured together, the excess plastic is then removed from the faceplate 14 as shown by dotted lines 14*a* in FIG. 6, so that the remaining portion of the faceplate and the shell 12 form a smooth contour.

The hearing aid is now ready to receive the module 20. As discussed, module 20 includes a plastic housing 22. Secured to the bottom of housing 22 is a printed circuit board 66. The electronic components of the module 20 (including volume control 26) are all mounted on or connected to the circuit board 66.

The electronic components include a conventional amplifier 68 mounted on the bottom of circuit board 66, a microphone 70 located below the amplifier 68, and an adjustment potentiometer 72 mounted on the top of the circuit board 66. The top of the potentiometer 72 is accessible for adjustment through opening 74 in the housing 22.

Figure 9:
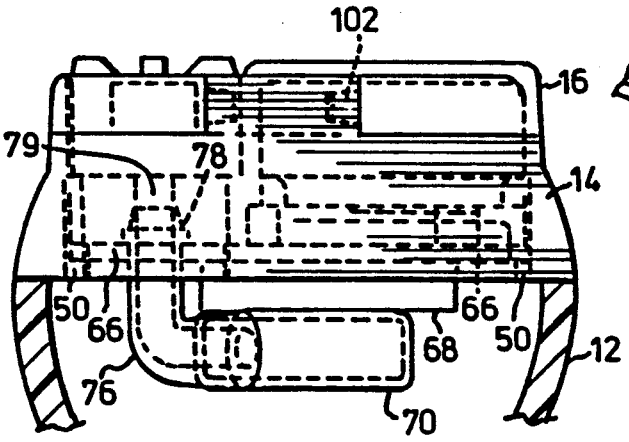
FIG. 9 is another sectional view showing the electronic module in the faceplate and shell.
Figure 8:
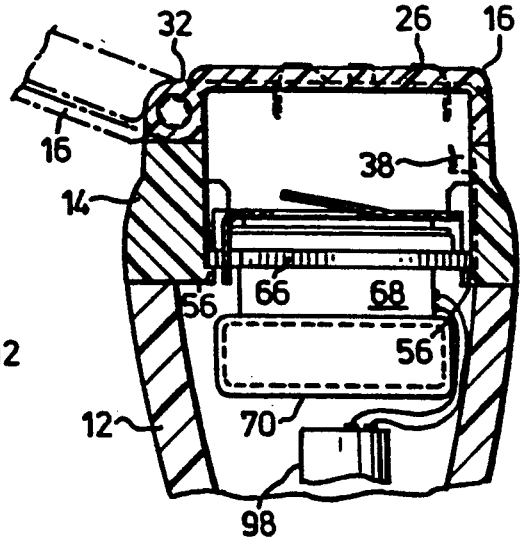
FIG. 8 is a sectional view showing the complete electronic module in the faceplate and shell.

The microphone 70 is held in place by an elbow-shaped rubber tube 76 (FIG. 9), which extends through a notch (not shown) in the side of the circuit board 66 and is then wedged into a hole 78 in the bottom of the plastic housing 22. The hole 78 extends upwardly into an opening 79 in the top of housing 22, for sound to reach the microphone.

Figure 10:
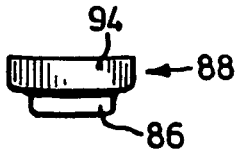
FIG. 10 (PRIOR ART)
FIG. 10 is a side view of a conventional battery used in the hearing aid of the invention.

The battery compartment 24 includes a bottom wall 80 which supports a battery bottom contact spring 82. Spring 82 includes a side tab 84 which extends downwardly to and is soldered to the circuit board 66. Spring 82 contacts the narrowed bottom portion 86 of a conventional battery 88 (FIG. 10).

The battery compartment 24 further includes a curved sidewall 90 located between the battery compartment and the volume control 26. Mounted on the curved sidewall 90 is a battery side contact spring 92. The curvature of the spring 92 is very slightly sharper than that of the upper sidewall 94 of the battery. Thus spring 92 firmly contacts battery sidewall 94. A tab 96 extends downwardly from spring 92 to the circuit board 66.

Before the module 20 is inserted into the faceplate 14, the receiver 28 (the wires 30 of which are also soldered to the circuit board 66) is lowered into the shell 12, so that it faces the aperture 18 in shell 12. The receiver 28 is normally surrounded by a rubber sleeve 98 (FIG. 1) with small rubber stand-offs (not shown) thereon, to provide vibration isolation between the receiver and the wall of the shell 12. The module 20 may then be snapped into the faceplate 14, where it is retained between the recesses 50 and the stops 56 of the faceplate, as described. The module 20 helps to hold the receiver in position in the shell.

Figure 11:
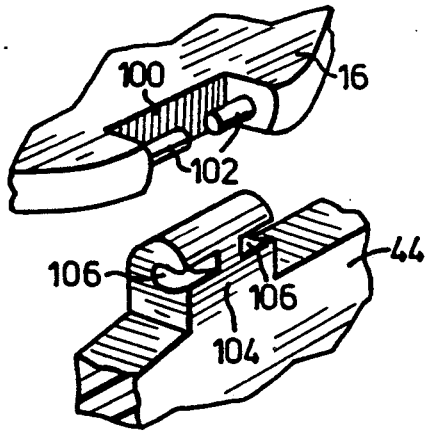
FIG. 11 is an exploded perspective view of the hinge between the lid and faceplate.
Figure 12:
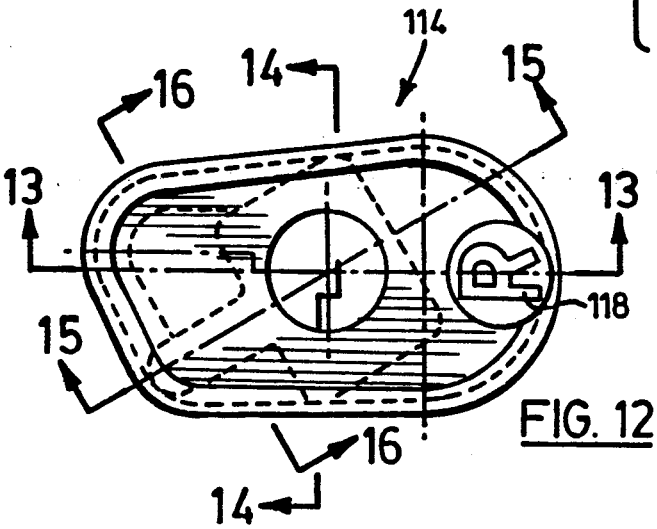
FIG. 12 is a top view showing a plastic gauge used to facilitate the assembly of the faceplate of FIG. 4 to the shell.
Figure 14:
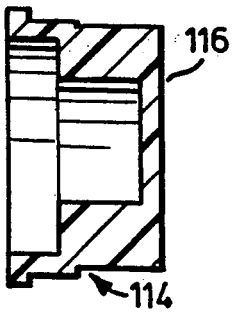
FIG. 14 is a sectional view along lines 14—14 of FIG. 12.
Figure 13:
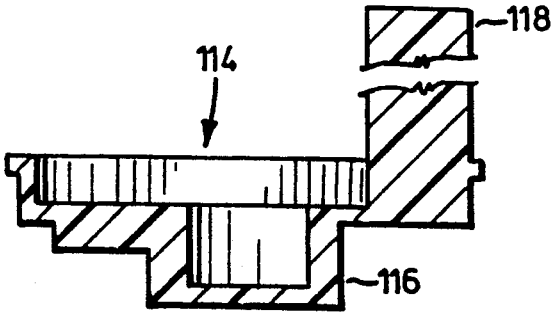
FIG. 13 is a sectional view along lines 13—13 of FIG. 12.
Figure 16:
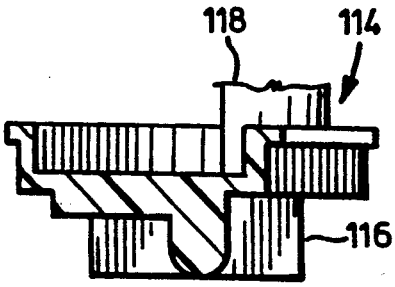
FIG. 16 is a sectional view along lines 16—16 of FIG. 12.
Figure 15:
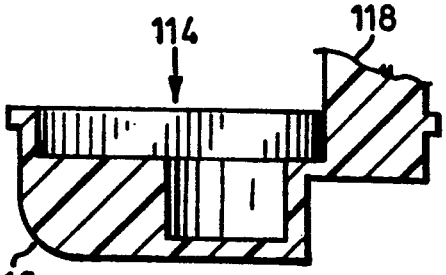
FIG. 15 is a sectional view along lines 15—15 of FIG. 12.

Next the lid 16 may be assembled to the faceplate 14. The lid 16 is also a molded plastic piece, shaped to match in outline that of the upper rim 44 of the faceplate 14. One edge of the lid 16 has a slot 100 molded therein (see FIGS. 1, 11). Cylindrical pins 102 extend one from each end of the slot 100 toward each other. The pins 102 and slot 100 together form half of the hinge 32.

The other half of hinge 32 is formed by an upstanding formation 104 molded in the faceplate upper rim 44. The formation 104 contains two slots 106 therein, one at each end thereof, to accommodate the pins 102 in a snap fit. The formation 104 does not extend laterally outwardly beyond the rim 44, so that it is less likely to be damaged when excess material is being removed from faceplate 14. Similarly it does not extend laterally inwardly into the faceplate opening 46, so as not to interfere with the module 20.

The plastic latch 38 of the lid 16 is molded integrally therewith. The latch catches in a recess 110 in the faceplate interior wall 48, to hold the lid closed. A conventional notch 112 (FIG. 3) in the lid allows the user to pry the lid open. The interior battery closure 34 of the lid also includes a recess 113 to accommodate the spring 92.

Because the lid 16 holds the battery 88 in position but does not itself contain any metal contacts, the lid 16 can easily be replaced should it become physically or cosmetically damaged. In addition the entire module 20 can readily be removed, without removing the lid, simply by pulling it out of the faceplate 14. Because the stresses acting in the module 20 are normally small, the snap fit detail (the recesses 50 and projections 52) used to hold it in the faceplate can be of very light construction, so that only a modest force is needed to remove the module.

When the faceplate 14 is being glued or welded to the shell 12, it is important to ensure that the positioning is such that the amplifier 68 and microphone 70, both of which project below the faceplate 14 will not interfere with the inside of the shell 12. For this purpose a plastic gauge 114 is used as shown in FIGS. 12 to 16. The plastic gauge 114 is a transparent molded plastic part having a circumferential outline which is the same as that of the housing 22 of the electronic module 20. The bottom contour 116 of the gauge 114 is shaped to simulate that of the module, including the circuit board 66, amplifier 68 and microphone 70. A plastic pin 118 extends upwardly from the gauge 114 and serves as a handle to allow the gauge to be grasped.

In use, before the faceplate 14 is glued or welded to the shell 12, the gauge 114 is first inserted into the faceplate opening 46. Then the faceplate 14 may be applied to the shell 12 and glued or welded in position. The fabricator may look through the transparent gauge 114 during the assembly process in order better to view the operation. After the fastening process is completed (or before if the faceplate 14 and shell 12 are each held in a jig, as will often be the case), the gauge 114 is removed by pulling on its upwardly projecting pin 118.

While in the embodiment shown, the volume control projects through the lid, if desired the volume may be preset and the volume control (if any) may be covered by the lid. Alternatively a push-button volume control may be used. The lid can cover part of the push-button or twist volume control and can expose part for access by a user.

If it is desired to provide wind noise protection for the hearing aid, then a foam insert (not shown) can be placed in hole 37 in the lid 16. Alternatively, a wind noise hood of standard configuration may be placed on the lid 16, extending part way over the hole 37 from one side thereof to provide protection against wind noise.

If desired, the shape either of the hole 37 in the lid 16 or of the opening 79 in the plastic housing 22 can be modified as desired to provide acoustic emphasis or de-emphasis in specific frequency bands. For example, if desired the hole 37 may be made funnel-shaped, being enlarged at its top and narrowed at its bottom, in order to gather additional sound over a broad frequency range.

Further, if it is desired to make the hearing aid directional, then an additional opening can be provided in lid 16 and a matching opening can be formed in housing 22 so that there will be two sound ports, one front and one rear. From the additional opening in the housing 22, a rubber tube can be directed to an additional port on the microphone 70.

Figure 17:
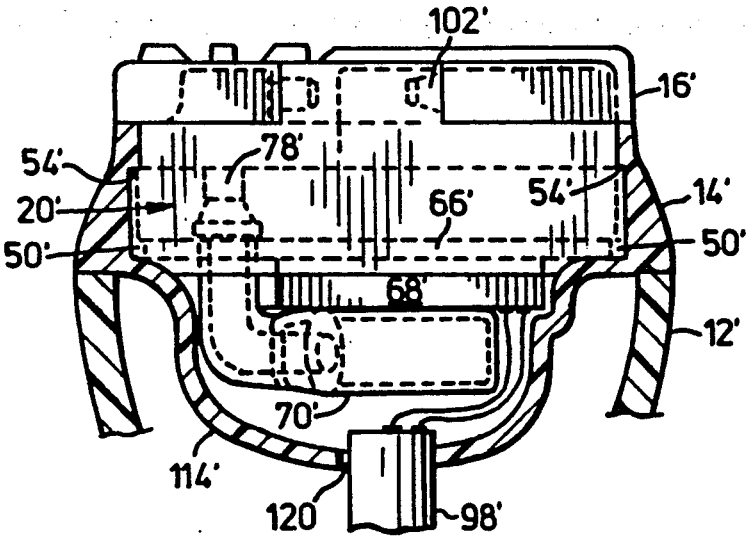
FIG. 17 is a view similar to that of FIG. 9 but showing a modification of the invention.

If desired, a thin shelled replica of the bottom contour of the gauge 114 can be molded integrally with the faceplate 14, forming a basket to provide the necessary gauging function and also to help retain the receiver 28 in position. This arrangement is shown in FIG. 17, where primed reference numerals indicate parts corresponding to those of FIGS. 1 to 16. As shown in FIG. 17, the gauge 114' is molded, of as thin plastic as possible, integrally with the faceplate 14. The gauge 114' is molded at the bottom of the faceplate 14, in effect replacing the stops 56, and is contoured to follow approximately the shape of the bottom of the module 20'. The module 20' snaps as before into the recesses 50' in the faceplate. An opening 120 in the bottom of the gauge 114' accommodates and helps to locate the sleeve 98' for the receiver.

We claim:

1. A hearing aid comprising:

(a) a shell adapted to fit within a user's ear and having an outer rim, (b) a faceplate fixed to said outer rim and having an opening therein, (c) an electronic module comprising a microphone, an amplifier connected to said microphone to amplify sound therefrom, a receiver connected to said amplifier to produce sound for said user, and a battery compartment to house a battery for said amplifier, said module being fitted within said opening of said faceplate and being removably attached to said faceplate, (d) said battery compartment having an open outer end, (e) a lid for said faceplate, said lid being adapted substantially to cover said module, there being no other lid to cover said module, said lid having an inside surface, said inside surface defining a closure for said open outer end of said battery compartment, (f) hinge means connected between said lid and said faceplate for said lid to be opened and closed, said lid when closed substantially covering said module, and said lid when closed being aligned for said closure for said battery compartment to close said battery compartment, said lid when open uncovering said battery compartment for removal of said battery and also uncovering said module so that said module can be removed from said faceplate, (g) and detent means for retaining said lid in a closed position.

2. A hearing aid according to claim 1 wherein said module includes an adjustment potentiometer, said potentiometer being covered by said lid when said lid is closed.

3. A hearing aid according to claim 1 wherein said module includes a volume control projecting outwardly therefrom, said lid having an aperture therein to expose at least a portion of said volume control when said lid is closed.

4. A hearing aid according to claim 1 wherein said lid includes an opening therein for sound to pass therethrough to reach said microphone.

5. A hearing aid according to claim 1 wherein said faceplate includes an outer edge, an interior wall, and recesses formed in said interior wall inwardly said outer edge, said module including a plastic housing contoured to snap fit into said recesses.

6. A hearing aid according to claim 4 wherein said faceplate includes an inner edge contacting said outer rim of said shell, and stop means projecting laterally into said opening from said interior wall adjacent said inner edge to limit movement of said plastic housing inwardly into said shell.

7. A hearing aid according to claim 1 wherein said faceplate comprises a plastic body, an annular rim extending outwardly from said body and encircling said opening, and a half-hinge formed on said rim and constituting a portion of said hinge means.

8. A hearing aid according to claim 1 wherein said module comprises a plastic housing, a printed circuit board secured to the bottom of said housing, an amplifier secured to said printed circuit board and extending downwardly therefrom, and a microphone connected to said housing and located below said amplifier.

9. A hearing aid according to claim 1 wherein said battery compartment includes a bottom wall having a first spring contact thereon to contact the bottom of a battery and a sidewall having a second spring contact therein to contact the sidewall of a battery.

10. A hearing aid according to claim 9 wherein said module comprises a plastic housing, said battery compartment being formed in said housing, a printed circuit board secured to the bottom of said housing, said first and second spring contacts being connected to said circuit board.

11. A hearing aid according to claim 1 and including a gauge molded integrally with said faceplate and extending inwardly into said shell, said gauge having a lower surface shaped to simulate approximately the shape of the lower surface of said module.

12. A hearing aid comprising: a shell adapted to be fitted within a user's ear, an electronic module containing electronic components and also containing a battery compartment, a faceplate connected to said shell, said faceplate comprising a plastic plate having an upwardly extending annular rim, said rim defining and encircling an opening through said faceplate, said module being received in said opening, said rim having an upper edge, a first hinge portion located on said upper edge of said rim, said first hinge portion not extending laterally outwardly beyond said rim and also not extending laterally inwardly into said opening, a cover for said module, said cover having a second hinge portion connected to said first hinge portion to hingedly attach said cover to said rim, said faceplate including retaining means separate from said first and second hinge portions for releasably retaining said module within said opening, said retaining means being substantially the sole means connecting said module to said faceplate.

13. A hearing aid according to claim 12 wherein said rim has an interior wall, said retaining means comprising recesses formed in said interior wall below said upper edge for providing a snap fit for said module.

14. A hearing aid according to claim 13 wherein said retaining means comprises stop means extending laterally into said opening from said interior wall to limit movement of said module inwardly into said opening.

* * * * *